US008866034B2

(12) United States Patent
Fasano

(10) Patent No.: US 8,866,034 B2
(45) Date of Patent: Oct. 21, 2014

(54) ARC RUNNER WITH INTEGRATED CURRENT PATH THAT DEVELOPS A MAGNETIC FIELD TO BOOST ARC MOVEMENT TOWARDS SPLITTER PLATES

(75) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 203 days.

(21) Appl. No.: 13/448,028

(22) Filed: Apr. 16, 2012

(65) Prior Publication Data

US 2012/0261382 A1 Oct. 18, 2012

Related U.S. Application Data

(60) Provisional application No. 61/475,478, filed on Apr. 14, 2011.

(51) Int. Cl.
*H01R 33/02* (2006.01)
*H01H 9/44* (2006.01)

(52) U.S. Cl.
CPC ..... *H01H 9/443* (2013.01); *H01H 9/446* (2013.01)
USPC ..... 218/156; 218/149

(58) Field of Classification Search
USPC ..... 218/149, 156
See application file for complete search history.

(56) References Cited

U.S. PATENT DOCUMENTS

| | | | | | |
|---|---|---|---|---|---|
| 4,843,194 | A * | 6/1989 | Orosz | 218/149 |
| 5,004,874 | A * | 4/1991 | Theisen et al. | 218/151 |
| 5,138,122 | A * | 8/1992 | Moldovan et al. | 218/22 |
| 5,313,033 | A * | 5/1994 | Link et al. | 200/401 |
| 5,731,561 | A | 3/1998 | Manthe et al. | |
| 5,818,003 | A * | 10/1998 | Moldovan et al. | 218/26 |
| 5,866,864 | A * | 2/1999 | Mody et al. | 218/38 |
| 5,874,873 | A * | 2/1999 | Hetzmannseder et al. | 335/16 |
| 6,262,384 | B1 * | 7/2001 | Niebler et al. | 218/156 |
| 6,300,586 | B1 * | 10/2001 | Doughty et al. | 218/148 |
| 6,717,090 | B2 | 4/2004 | Kling et al. | |
| 8,334,740 | B2 * | 12/2012 | Annis et al. | 335/201 |
| 8,368,492 | B1 * | 2/2013 | Theisen et al. | 335/201 |

* cited by examiner

*Primary Examiner* — Truc Nguyen
(74) *Attorney, Agent, or Firm* — St. Onge Steward Johnston & Reens LLC

(57) ABSTRACT

A circuit interrupter for cooling and quenching an electrical arc having a housing with a first contact and a second contact movable with respect to the first contact. An arc splitter is located in an arcing chamber, and an arc runner is located near the second contact. The arc runner has an arc strap facing toward the first contact, a first wall shaped as a rectangular spiral perpendicularly extending from the arc strap, a second wall shaped as a rectangular spiral perpendicularly extending from to the arc strap and opposite the first wall. The arc runner generates a magnetic force on the arc forcing the arc toward the arc splitter.

25 Claims, 7 Drawing Sheets

ARC RUNNER WITH INTEGRATED CURRENT PATH THAT DEVELOPS A MAGNETIC FIELD TO BOOST ARC MOVEMENT TOWARDS SPLITTER PLATES

CROSS-REFERENCE TO RELATED APPLICATIONS

The present application claims the benefit under 35 U.S.C. §119 (e) of the U.S. Provisional Patent Application No. 61/475,478 filed on Apr. 14, 2011.

FIELD OF THE INVENTION

The present invention relates generally to the protection of electrical devices, and more specifically, relates to a circuit interrupter with an arc runner that creates a magnetic field to aid in rapidly extinguishing an electrical arc.

BACKGROUND OF THE INVENTION

A circuit interrupter is an electrical component that can break an electrical circuit, interrupting the current. A basic example of a circuit interrupter is a switch, which generally consists of two electrical contacts in one of two states; either closed meaning the contacts are touching and electricity can flow between them, or open, meaning the contacts are separated. A switch may be directly manipulated by a human as a control signal to a system, such as a computer keyboard button, or to control power flow in a circuit, such as a light switch.

A second example of a circuit interrupter is a circuit breaker. A circuit breaker is used in an electrical panel that monitors and controls the amount of amperes (amps) being sent through the electrical wiring. A circuit breaker is designed to protect an electrical circuit from damage caused by an overload or a short circuit. If a power surge occurs in the electrical wiring, the breaker will trip. This will cause a breaker that was in the "on" position to flip to the "off" position and shut down the electrical power leading from that breaker. When a circuit breaker is tripped, it may prevent a fire from starting on an overloaded circuit; it can also prevent the destruction of the device that is drawing the electricity.

A standard circuit breaker has a line and a load. Generally, the line is the incoming electricity, most often from a power company. This can sometimes be referred to as the input into the circuit breaker. The load, sometimes referred to as the output, feeds out of the circuit breaker and connects to the electrical components being fed from the circuit breaker. There may be an individual component connected directly to a circuit breaker, for example only an air conditioner, or a circuit breaker may be connected to multiple components through a power wire which terminates at electrical outlets.

A circuit breaker can be used as a replacement for a fuse. Unlike a fuse, which operates once and then has to be replaced, a circuit breaker can be reset (either manually or automatically) to resume normal operation. Fuses perform much the same duty as circuit breakers, however, circuit breakers are safer to use than fuses and are easier to fix. If a fuse blows, oftentimes a person will not know which fuse controls which specific power areas. The person will have to examine the fuses to determine which fuse appears to be burned or spent. The fuse will then have to be removed from the fuse box and a new fuse will have to be installed.

Circuit breakers are much easier to operate than fuses. When the power to an area shuts down, the person can look in the electrical panel and see which breaker has tripped to the "off" position. The breaker can then be flipped to the "on" position and power will resume again. In general, a circuit breaker has two contacts located inside of a housing. The first contact is stationary, and may be connected to either the line or the load. The second contact is movable with respect to the first contact, such that when the circuit breaker is in the "off" or tripped position, a gap exists between the first and second contact.

The problem, with circuit interrupters, is that even though the circuit interrupter may be in the open position, i.e. a switch is open or a circuit breaker has tripped, interrupting the connection, the open area between the first and second contact allows an electrical arc to form between the two contacts. The electrical arc is the residual electricity and may have a high voltage and amperage. Arcs can be dangerous as they can cause damage to the circuit interrupter, specifically damaging the electrical contacts. Any damage to the electrical contacts shortens the lifespan of the circuit interrupter, and affects its performance. It is, therefore, very important to quickly cool and quench the arc to prevent damage to the circuit interrupter.

There have been many proposed devices to quickly quench an electrical arc. For example, U.S. Pat. No. 5,731,561 to Manthe et al. discloses a device with a sealed arc chamber. Inside of the sealed arc chamber is a gas designed to quench the arc that is formed when the circuit breaker trips. A disadvantage of this device is that is expensive to produce. The circuit breaker requires a sealed chamber, which is expensive to manufacture and test, and also requires a specific, arc quenching, gas. The combination of the sealed chamber and the gas make this device very expensive. Additionally, any leaks in the chamber will cause a leak in the gas, preventing any quenching from taking place.

U.S. Pat. No. 6,717,090 to Kling et al. discloses a device with an arc splitter stack into which the arc passes via guide rails. A disadvantage of the device proposed in Kling is that is does not rapidly quench the arc. While providing some quenching using the arc splitter, the arc splitter alone does not provide enough cooling to quickly quench the arc.

What is desired, therefore, is a circuit interrupter that can quickly cool and quench an arc, that is inexpensive to produce, and provides rapid cooling to protect the electrical contacts in the circuit interrupter.

SUMMARY OF THE INVENTION

The invention is directed to a circuit breaker for rapidly cooling and quenching an arc. The circuit breaker directs the flow of the arc through a specially designed arc runner that uses the magnetic force of the flow of electricity to quickly force the arc from the second electrical contact to the arc splitter.

These and other objects of the present invention are achieved by provision of a circuit interrupter having a housing with a first contact and a second contact movable with respect to the first contact. An arc splitter is located in an arcing chamber, and an arc runner is located near the second contact. The arc runner has an arc strap facing toward the first contact, a first wall shaped as a spiral perpendicularly extending from the arc strap, and a second wall shaped as a spiral perpendicularly extending from the arc strap and opposite the first wall with respect to the arc strap. The arc runner is configured to generate a magnetic force on an arc forcing the arc toward the arc splitter.

In some embodiments of the present invention, the first contact is fixed to the housing. In some embodiments of the present invention, the arc splitter has a plurality of spaced apart plates. In certain embodiments of the present invention, at least one magnet is located in the arcing chamber forcing the arc towards the arc splitter. In certain embodiments of the present invention, the at least one magnet is a permanent magnet or an iron plate magnet. In certain embodiments of the present invention, the iron plate magnet is configured to generate a magnetic force using a current flowing through the circuit breaker. In some embodiments of the present invention, the first and second walls are electrically connected to a coil. In certain embodiments of the present invention, the circuit interrupter is a circuit breaker. In some embodiments of the present invention, the spiral is a rectangular spiral.

In another embodiment of the present invention is a circuit interrupter having a housing composed of a first side and a second side opposite the first side. A first contact is located substantially towards the first side and a second contact is located substantially towards the first side and is movable with respect to the first contact. An arcing chamber is located substantially towards the first side; the arcing chamber has an arc splitter located inside. An arc runner is located in the arcing chamber. The arc runner has an arc strap parallel to the second end of the housing and is located substantially near the second end of the housing. The arc runner has a first wall perpendicularly extending from the arc strap. The first wall has a first leg and a second leg running substantially parallel to the first side. The arc runner further has a second wall perpendicularly extending from the arc strap having a first leg and a second leg running substantially parallel to the first side.

In some embodiments of the present invention, the arc splitter has a plurality of spaced apart plates. In some embodiments of the present invention, at least one magnet is located in the arc chamber forcing the arc towards the arc splitter. In certain embodiments of the present invention, the at least one magnet is a permanent magnet or an iron plate magnet. In certain embodiments of the present invention, the iron plate magnet is configured to generate a magnetic force using a current flowing through the circuit breaker. In some embodiments of the present invention, the first wall and the second wall are electrically connected to a coil. In some embodiments of the present invention, the first wall further has a third leg located substantially towards the first end connecting the first leg to the second leg and a fourth leg located substantially towards the second end connected to the second leg, and the second wall further has a third leg located substantially towards the first end connecting the first leg to the second leg and a fourth leg located substantially towards the second end connected to the second leg. In some embodiments of the present invention, the circuit interrupter is a circuit breaker.

In another embodiment of the present invention is a circuit breaker having a housing with a first contact and a second contact movable with respect to the first contact. An arc splitter is located in an arcing chamber. An arc runner is located in the arcing chamber. The arc runner has two wings configured to generate a magnetic force on an arc forcing the arc toward the arc splitter.

In some embodiments of the present invention, the first contact is fixed to the housing. In some embodiments of the present invention, the arc splitter has a plurality of spaced apart plates. In certain embodiments of the present invention, at least one magnet is located in the arcing chamber forcing the arc towards the arc splitter. In certain embodiments of the present invention, the at least one magnet is a permanent magnet or an iron plate magnet. In some embodiments of the present invention, the iron plate magnet generates a magnetic force using the current flowing through the circuit breaker. In some embodiments of the present invention, the wings are electrically connected to a coil.

In another embodiment of the present invention is a device for boosting an electrical arc toward an arc splitter having an arc splitter and an arc runner with an electrical conductor configured to boost an electrical arc toward the arc splitter.

In some embodiments of the present invention, the electrical conductor is located on a side of the arc opposite of the arc splitter. In some embodiment of the present invention, the electrical conductor is located on a same side of the arc as the arc splitter. In certain embodiments of the present invention, the device further has a second electrical conductor. In certain embodiments of the present invention, the second electrical conductor is on a side of the arc opposite the arc splitter. In certain embodiments of the present invention, the second electrical conductor is located on a same side of the arc as the arc splitter.

DETAILED DESCRIPTION OF THE INVENTION

Figure 1:
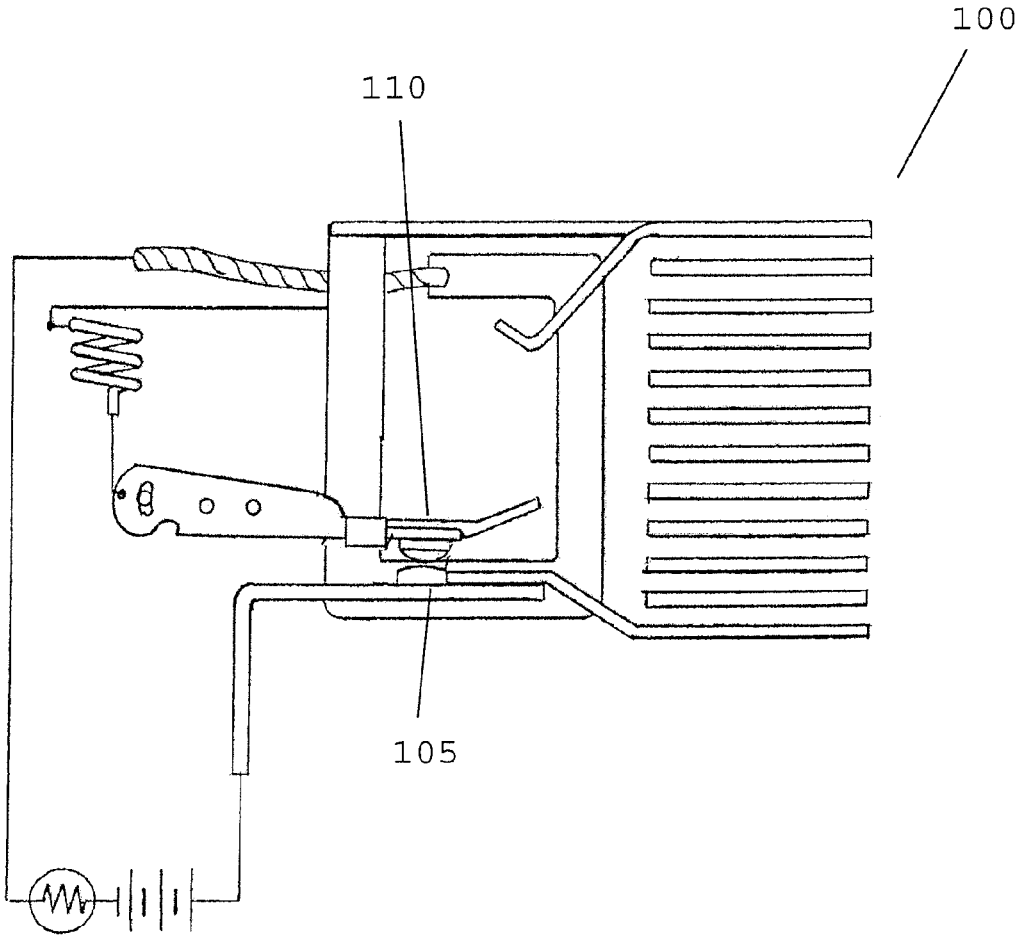
FIG. 1 is a side view of a circuit interrupter, in a closed position, according to the present invention.

The exemplary embodiments of the present invention may be further understood with reference to the following description and the related appended drawings, wherein like elements are provided with the same reference numerals. The exemplary embodiments of the present invention are related to a device for quenching an electrical arc. Specifically, the device uses magnetic fields to quickly boost arc movement toward an arc splitter, thereby causing the arc to be quickly cooled and quenched. The exemplary embodiments are described with reference to a circuit breaker, but those skilled in the art will understand that the present invention may be implemented on any electrical device that has electrical contacts that can be opened and closed.

As best seen in FIG. 1, a partial side view of a partial circuit breaker 100, in a closed position, is shown. Circuit breaker 100 can be used in any commercial or non-commercial application, and may be designed to replace current circuit breakers without the need to modify existing equipment. Circuit breaker 100 is designed to quickly cool and quench an arc; this allows circuit breaker 100 to be used with equipment that requires a high voltage. For example, the circuit breaker may have dimension as small as 2.625 inches high, 3.7 inches long, and 0.5 inches thick. A typical circuit breaker of this size is rated for a voltage of approximately 160 V; however, a circuit breaker according to the present invention can be rated at 250 volts or higher. It should be noted that the dimensions above are purely exemplary, and the current design can be used in any size circuit breaker, larger or smaller than detailed above, and can be rated for a voltage higher or lower than 250 volts.

Circuit breaker 100 has a first electrical contact 105. Electrical contact 105 may be mounted directly to a housing (not shown) or may be mounted inside of the housing, not directly on the housing. Electrical contact 105 is generally connected to the line, or the incoming voltage, however, electrical contact 105 can also be connected to the load. Circuit breaker 100 has a second electrical contact 110. Generally electrical contact 110 is connected to the load, or the equipment drawing power, however, electrical contact 110 may be connected to the line or the load. Electrical contact 110 is movable with respect to electrical contact 105. During normal operation, circuit breaker 100 is in a closed position whereby electrical contact 110 touches electrical contact 105. This allows electricity to flow from the line to the load. If there is an overload or a short in the circuit, circuit breaker 100 automatically trips, causing electrical contact 110 to separate from electrical contact 105.

Figure 2:
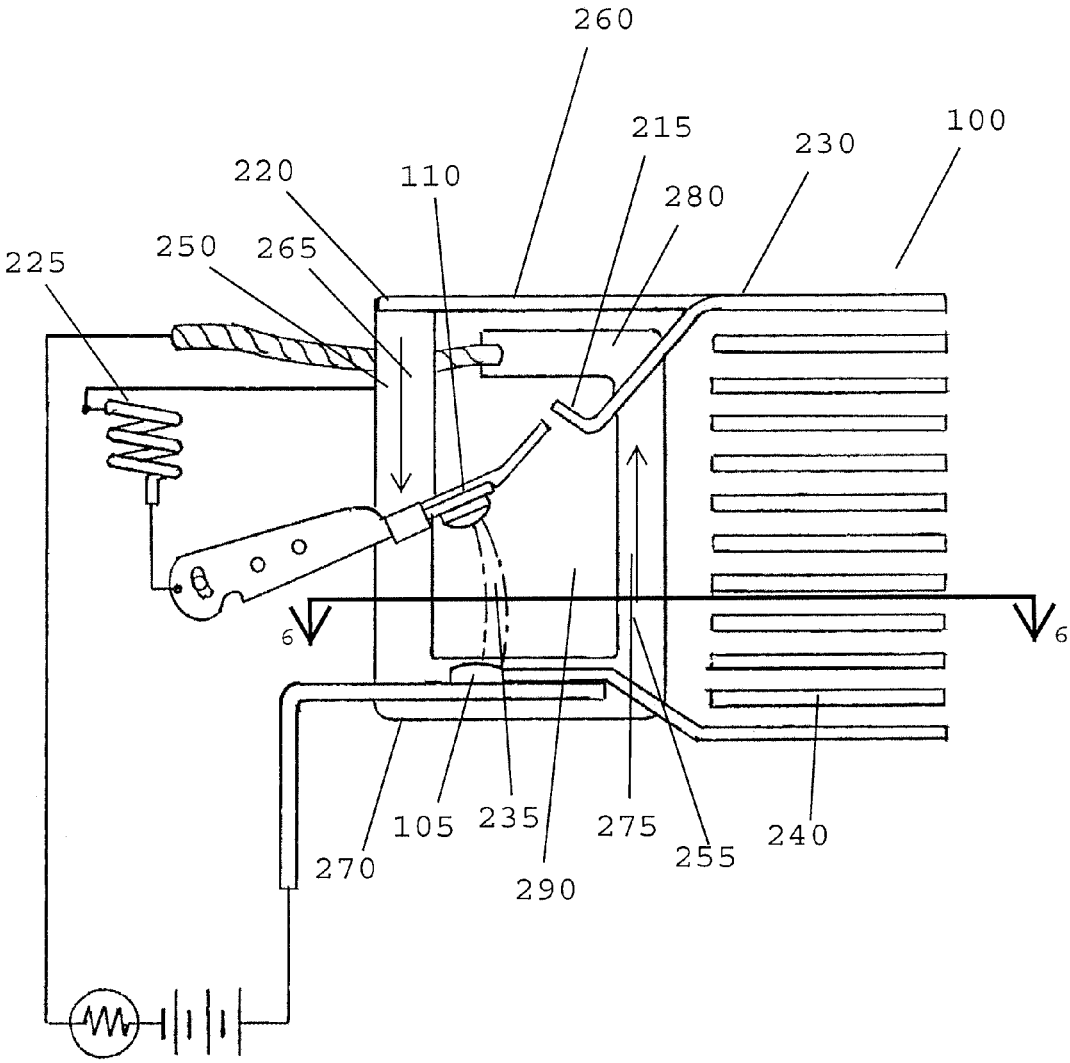
FIG. 2 is a side view of the circuit interrupter from FIG. 1 in an open position.
Figure 3:
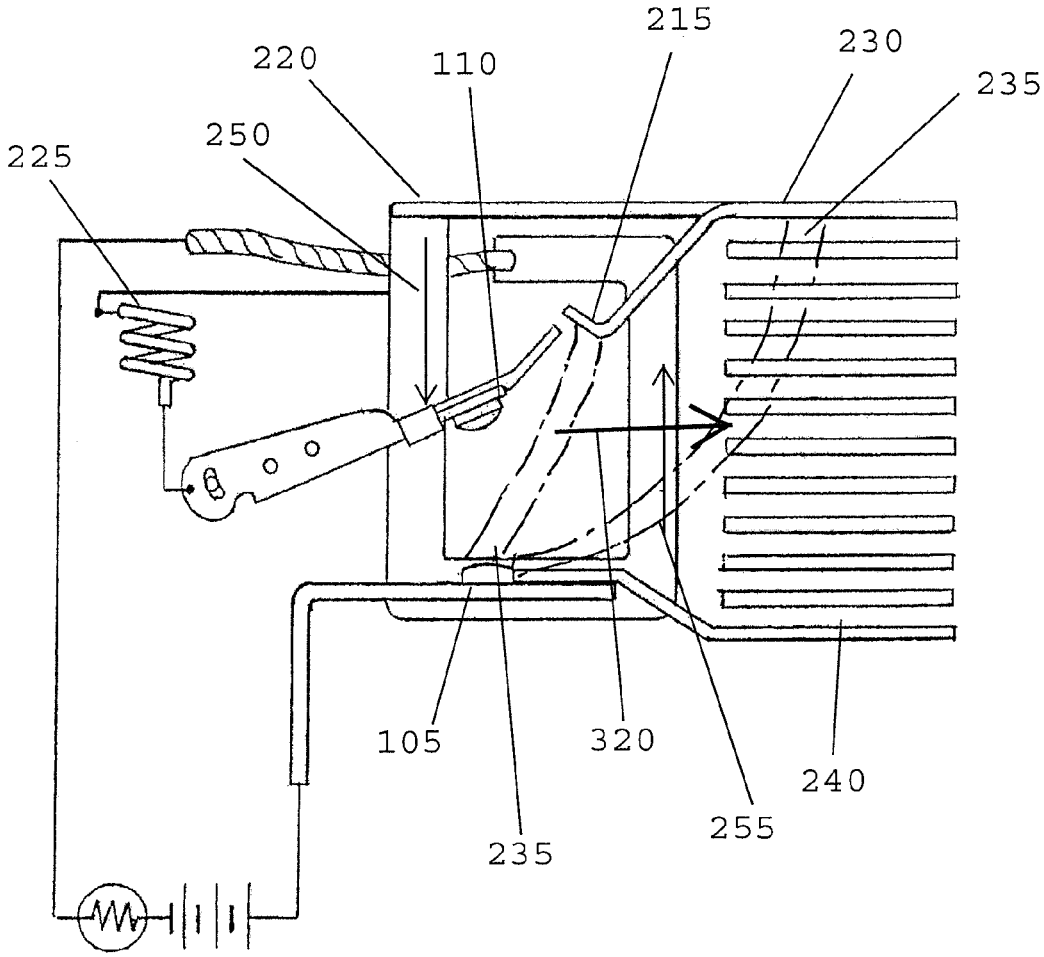
FIG. 3 is a side view of the circuit interrupter from FIG. 1 in an open position.

As best seen in FIGS. 2 and 3, a side view of a partial circuit breaker, in the opened or tripped position, is shown. Although electrical contact 110 has separated from electrical contact 105, electricity, in the form of an arc 235 may still flow from electrical contact 105 to electrical contact 110. Arc 235 is capable of jumping between electrical contacts, through air in arc chamber 290, and can cause severe damage to both contacts. In a worst case scenario a single arc 235 can damage the contacts so severely as to render them inoperable during normal operation. At best, electrical arc 235 can shorten the lifespan of the electrical contacts, shortening the lifespan of circuit breaker 100. This would require the frequent replacement of circuit breaker 100, which can be both costly and difficult depending on the location of the circuit breaker. To protect the electrical contacts, and the circuit breaker, the arc must be extinguished as quickly as possible. This is done by pushing arc 235 into an arc splitter 240. Arc splitter 240 may be a plurality of spaced apart plates which draws in arc 235, and cools and quenches the arc. To provide a quicker cooling and quenching of arc 235, it is beneficial to provide additional magnetic forces pushing or pulling arc 235 into arc splitter 240.

To provide additional magnetic forces, an arc runner 230 is used to push arc 235 into arc splitter 240. After the arc is initially created between electrical contacts 105 and 110, the arc moves to contact arc runner 230 Arc runner 230 has an arc strap 215 that may face electrical contact 105 to provide a large surface area for arc 235 to come into contact with. However, arc strap 215 can face any direction, or be of any or size, such that arc 235 can contact arc strap 215. When arc 235 hits arc strap 215, the current may be split into two side walls 220. (Note: only one sidewall is shown in FIGS. 2 and 3). The side walls are composed of rectangular spirals emanating from arc strap 215. Each side wall 220 may have five legs forming the perpendicular spiral; however, each side wall 220 can have more or less than five legs. The first leg 260 is connected directly to arc strap 215, and runs in a direction approximately perpendicular to arc 235. A second leg 265 is perpendicularly connected to the first leg 260, running parallel to arc 235, having a current 250 that runs in a direction opposite to that of arc 235. A third leg 270 is perpendicularly connected to the second leg 265, running parallel to the first leg. A fourth leg 275 is perpendicularly connected to the third leg 270 running parallel to the second leg 265 and has a current 255 running in the same direction as that of arc 235. A fifth leg 280 is perpendicularly connected to the fourth leg 275, running parallel to first leg 260 and third leg 270. While the example above, and FIGS. 1-3, show a rectangular spiral composed of a single conductor changing directions, side wall 220 may be a spiral of any shape. Additionally, side wall 220 may be composed of separate conductors that are electrically connected, but not composed of the same conductor changing directions.

Coil 225 may be electrically connected to side wall 220, either electrically connected to second leg 265 or to arc strap 215. By connecting coil 225 to side wall 220 or to arc strap 215, a magnetic field can be generated through side wall 220 while circuit breaker 100 is in the closed position. This allows for arc runner 230 to quickly boost arc 235 into arc splitter 240.

As explained in detail below, the direction of each leg causes magnetic fields in certain directions, which causes arc 235 to be quickly boosted toward arc splitter 240 (as shown by the direction of arrow 320). This causes arc 235 to be quickly cooled and quenched, protecting electrical contacts 105 and 110, as well as circuit breaker 100.

Figure 4:
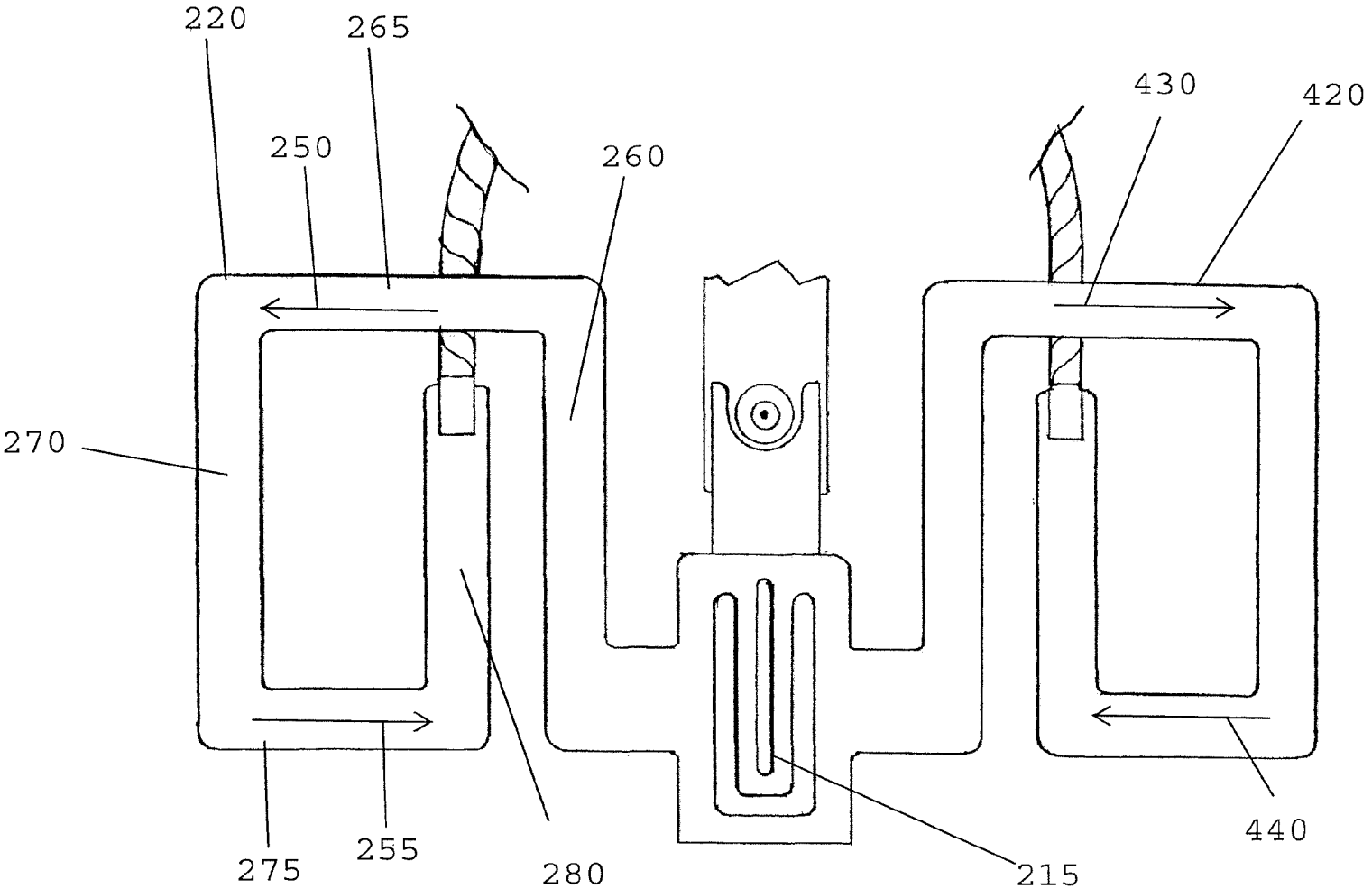
FIG. 4 is a bottom-up view of an unfolded arc runner from FIG. 1.

As best seen in FIG. 4, an unfolded arc runner 230, according to FIG. 1, is shown. Arc runner 230 is shown with two side walls 220 and 420 each shaped as a rectangular spiral, and functionally described below with reference to FIGS. 7-9. FIG. 4 further shows electrical currents 430 and 440 flowing through side wall 420. Electrical currents 430 and 440 are generated from arc 235 contacting arc strap 215, and are functionally the same as electrical currents 250 and 255.

Figure 5:
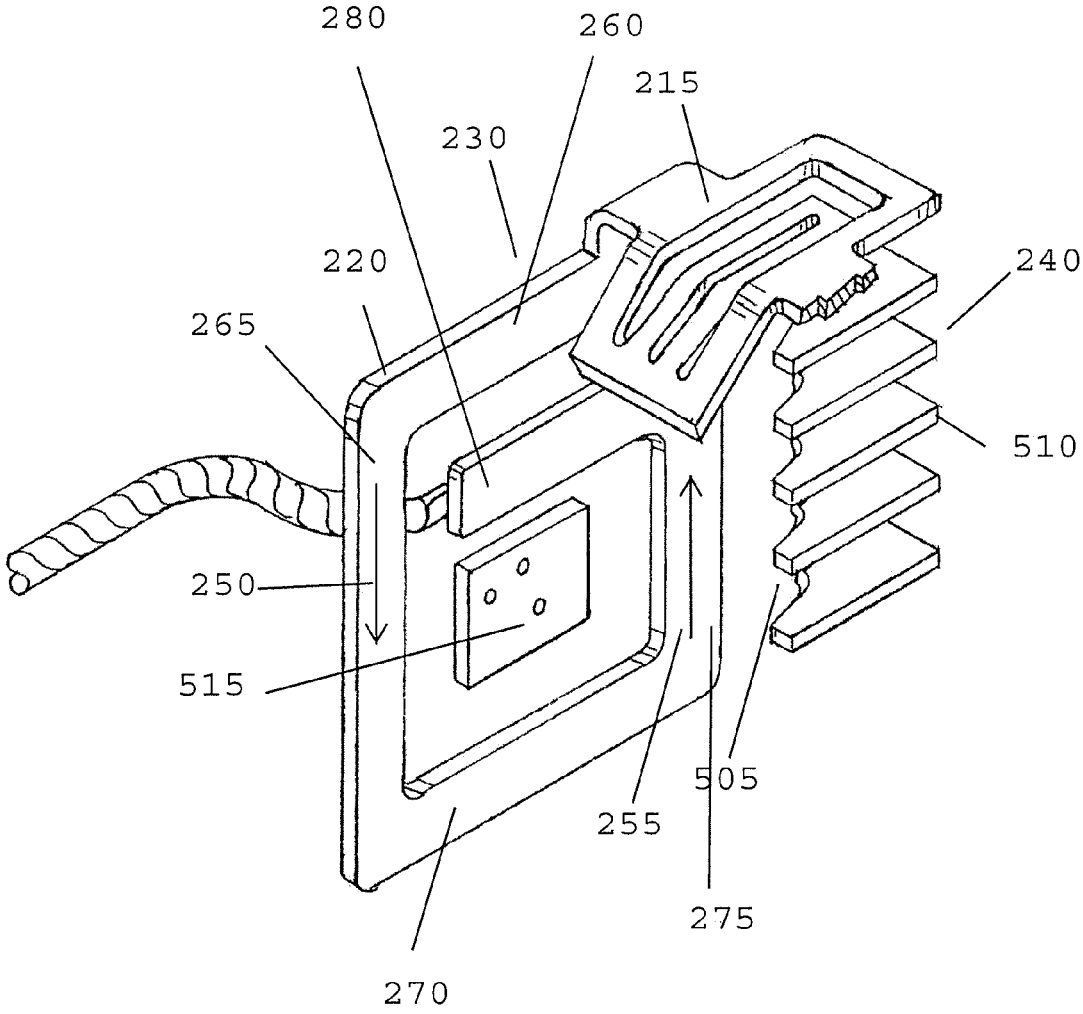
FIG. 5 is a perspective view of a portion of an arc runner from FIG. 1.

As best seen in FIG. 5, a perspective view of arc runner 230 is shown. Arc strap 215 is connected to side wall 220. Side wall 220 causes an arc (not shown) to be pushed toward arc splitter 240. Arc splitter 240 may be composed of a plurality of spaced apart plates 510. Each plate 510 may have a v-shaped opening 505 that the arc can run through. The shape of plate 510 may produce a pulling force, pulling an arc into the arc splitter. Arc runner 230 may further have a magnet 515. Magnet 515 may be a permanent magnet or iron plate magnet. A permanent magnet is magnetized prior to insertion into the circuit breaker. It causes a constant magnetic force of a predefined polarity. A permanent magnet can provide a large magnetic force, pushing arc 235 toward arc splitter 240. If an iron plate is used, the current from the arc is used to generate a magnetic force in the iron plate, causing the arc 235 to move toward arc splitter 240. An iron plate may not provide as large a magnetic force as a permanent magnet, however, the direction of the magnetic force can change if the direction of the current in the circuit breaker changes, making an iron plate more versatile than a permanent magnet. Magnet 515 may also be any other type of known component that can produce a magnetic force. Magnet 515 may be placed inside the area created by the rectangular spiral of side wall 220, or magnet 515 may be placed in another location to provide for a magnetic force on an arc.

Figure 6:
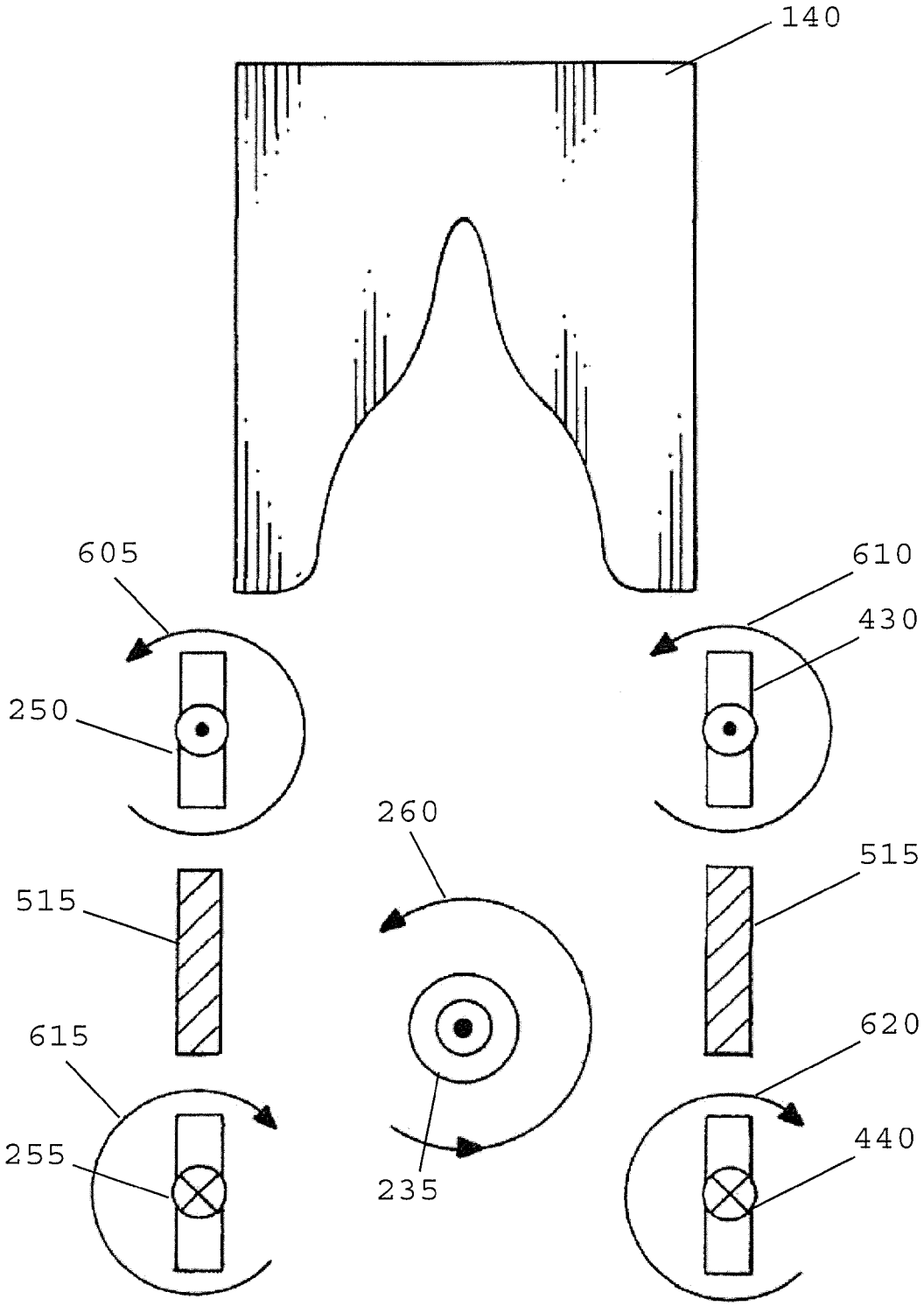
FIG. 6 is a top down view of an arc runner taken along line 6-6 from FIG. 2.

As best seen in FIG. 6, a top-down view of an arc runner and an arc splitter is shown. An arc 235 is generated with a magnetic field 260 running in a counterclockwise direction. The arc 235 is initially generated between two electrical contacts, and is forced into an arc strap of an arc runner. The current from the arc 235 runs through an arc strap and through electrical conductors 255 and 440 running in a downward direction and then through conductors 250 and 430 running in an upward direction. Magnetic forces 605, 610, 615, and 620 are generated with magnetic forces 605 and 610 running in a counterclockwise direction, and magnetic forces 615 and 620 running in a clockwise direction. As described in detail below, the interacting magnetic forces boosts arc 235 toward arc splitter 240.

In addition to the magnetic forces produced by the electrical conductors, magnets 515 may be used to provide additional forces, causing arc 235 to be boosted toward arc splitter 240 more quickly. The quicker arc 235 is boosted further into arc splitter 240, the quicker arc 235 can be cooled and quenched. As described above, magnet 515 may be a permanent magnet, an iron plate magnet, or any other component capable of producing a magnetic force.

Figure 7:
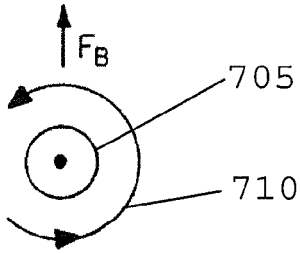
FIG. 7 is a schematic representation of an electrical conductor with a magnetic field illustrating operation of the circuit interrupter of FIG. 1.

As best seen in FIG. 7, a schematic representation of an electrical conductor is shown. 705 is an electrical conductor as seen from the top. The electrical current running through the electrical conductor 705 is running in upward direction. As is know the in the art, when a current is flowing through an electrical conductor 705, a magnetic force 710 is generated around the conductor 705. The magnetic force 710 runs perpendicular to the direction of the current, running circumferentially around the conductor 705. The direction of the magnetic force 710 depends on the direction of the electrical current, and is governed by the right hand rule which states that if a person places their hand in a first with their thumb up, the magnetic field 710 runs in a counterclockwise direction around their thumb. Conversely, if a person points their thumb down, magnetic field 710 would run in a clockwise direction.

Figure 8:
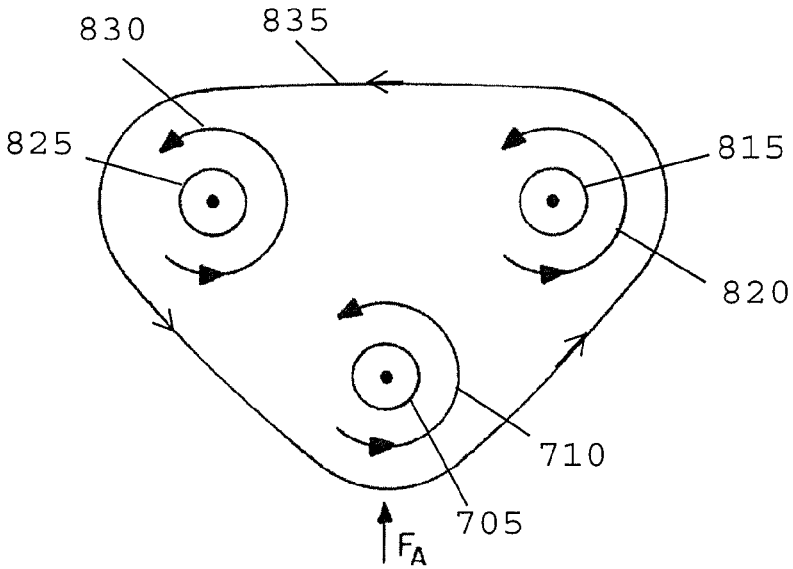
FIG. 8 is a schematic representation of an electrical arc and two electrical conductors each with its own magnetic field illustrating operation of the circuit interrupter of FIG. 1.

As best seen in FIG. 8, a schematic representation of three electrical conductors is shown. Electrical conductors 705, 820 and 825 each have a current that flows in an upward direction. This results in electrical conductors 705, 815, and 825 having an electrical field (710, 820, and 830 respectively) flowing in a counterclockwise direction around the flow of the current through the electrical conductor 705. As the magnetic field flows in a counterclockwise direction the top portion of the field runs in a right-to-left direction, and the bottom portion of the field runs in a left-to-right direction. When the bottom portions of magnetic fields 820 and 830 interact with the top portion of magnetic field 710, the magnetic forces, at least to some degree, cancel each other out. The remaining forces of magnetic fields 820 and 830 produce a pulling force on electrical conductor 705, and the remaining portion of magnetic field 710 produces a pushing force on arc 705. The combination of the pulling and pushing forces produces a counterclockwise magnetic field 835 causing the arc to be forced in the direction of $F_A$. This is referred to as the slot effect, whereby a magnetic field, either pushing or pulling, causes the current flowing through the conductor to be pushed or pulled by the magnetic force. In the case of an electrical arc, which has no physical conductor, the arc is pushed or pulled by the magnetic force in a direction towards or away from the magnetic force.

Figure 9:
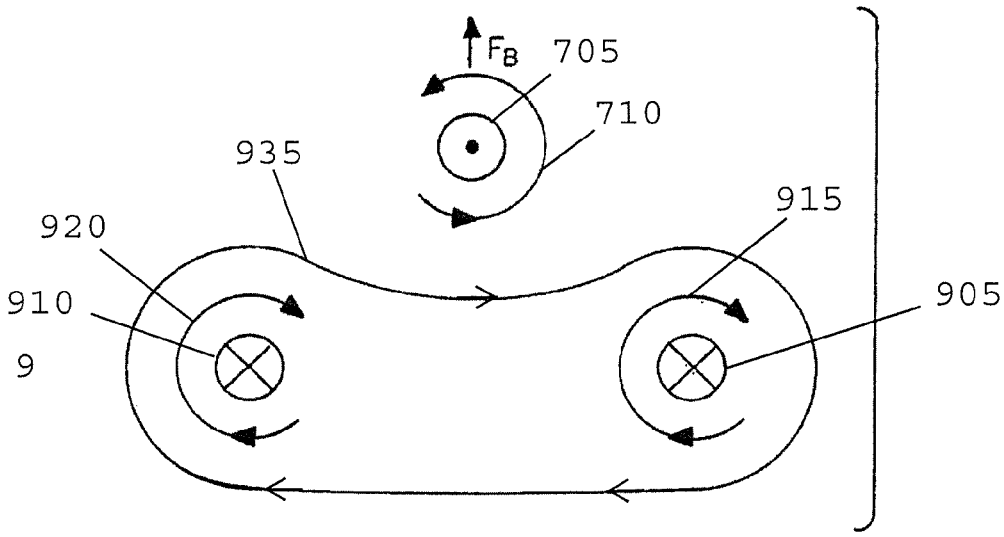
FIG. 9 is a schematic representation of an electrical arc and two electrical conductors each with its own magnetic field illustrating operation of the circuit interrupter of FIG. 1.

As best seen in FIG. 9, a schematic representation of three electrical conductors is shown. Electrical conductor 705 has a current that flows in an upward direction, and electrical conductors 905 and 910 each have a current that flows in a downward direction. This results in electrical conductor 705 having a magnetic field 710 that runs counterclockwise around electrical conductor 705, and electrical conductors 905 and 910 each have a magnetic field (915 and 920 respectively) flowing in a clockwise direction. The top portion of magnetic field 705 runs in a right-to-left direction and the bottom portion of magnetic field 705 runs in a left-to-right direction. The top portion of magnetic fields 915 and 920 run in a left-to-right direction, and the bottom portion of magnetic fields 915 and 920 run in a right-to-left direction. The combination of magnetic fields 915 and 920 produce a clockwise magnetic field 935. The left-to-right force of magnetic field 935 combines with the bottom portion of magnetic field 710, which also runs in a left-to-right direction. Additionally, the combination of the two magnetic fields cancels out at least a portion of the top of magnetic field 710, this causes arc 705 to move in the direction of $F_B$.

This device has the advantage in that it can be rated for use with a much higher voltage than a standard circuit breaker while still retaining a small size. It can quickly cool and quench an arc by using magnetic fields to boost the electrical arc towards the arc splitter, and can protect the electrical contacts, and the circuit breaker, from damage, extending the lifespan of the circuit breaker. This provides for a large cost savings as it saves money in the cost of a replacement of a circuit breaker, and the cost of labor in replacing the circuit breaker.

It would be appreciated by those skilled in the art that various changes and modification can be made to the illustrated embodiment without departing from the spirit of the invention. All such modification and changes are intended to be covered hereby.

What is claimed is:

1. A circuit interrupter comprising:
- a housing having a first contact and a second contact movable with respect to said first contact;
- an arcing chamber;
- an arc splitter located in said arcing chamber;
- an arc runner in said arcing chamber, said arc runner comprising:
  - an arc strap facing toward said first contact;
  - a first wall shaped as a spiral perpendicularly extending from said arc strap;
  - a second wall shaped as a spiral perpendicularly extending from said arc strap, said second wall being opposite said first wall with respect to said arc strap;
- wherein said arc runner is configured such that when a current runs through said arc runner a magnetic force is generated forcing an arc toward said arc splitter.

2. The circuit interrupter of claim 1, wherein said first contact is fixed to said housing.

3. The circuit interrupter of claim 1, wherein said arc splitter has a plurality of spaced apart plates.

4. The circuit interrupter of claim 1, wherein at least one magnet is located in said arcing chamber pushing said arc towards said arc splitter.

5. The circuit interrupter of claim 4, wherein said at least one magnet is one of a permanent magnet and an iron plate.

6. The circuit interrupter of claim 5, wherein said iron plate is configured to generate a magnetic force when the current flows through the circuit interrupter.

7. The circuit interrupter of claim 6, wherein a coil is electrically connected to said arc runner.

8. The circuit interrupter of claim 6, wherein the circuit interrupter is a circuit breaker.

9. The circuit interrupter of claim 1, wherein said spiral is a rectangular spiral.

10. A circuit interrupter comprising:
- a housing having a first side, a second side opposite said first side, a first end, and a second end opposite said first end, said first end and said second end connecting said first side to said second side;
- a first contact located substantially towards said first side;
- a second contact located substantially towards said first side movable with respect to said first contact;
- an arcing chamber located substantially towards said first side;
- an arc splitter located in said arcing chamber;

an arc runner located in said arcing chamber, said arc runner comprising:

an arc strap located in a plane substantially parallel to said second end of said housing located substantially near said second end of said housing;

a first wall perpendicularly extending from said arc strap, said first wall having a first leg and a second leg running in a plane substantially parallel to said first side;

a second wall perpendicularly extending from said arc strap, said second wall having a first leg and a second leg running in a plane substantially parallel to said first side;

wherein said arc runner is configured such that when a current runs through said arc runner a magnetic force is generated forcing an arc toward said arc splitter.

11. The circuit interrupter of claim 10, wherein said arc splitter has a plurality of spaced apart plates.

12. The circuit interrupter of claim 10, wherein at least one magnet is located in said arcing chamber pushing said arc towards said arc splitter.

13. The circuit interrupter of claim 12 wherein said at least one magnet is one of a permanent magnet and an iron plate.

14. The circuit interrupter of claim 13, wherein said iron plate is configured to generate a magnetic force when the current flows through the circuit interrupter.

15. The circuit interrupter of claim 10, wherein a coil is electrically connected to said arc runner.

16. The circuit interrupter of claim 10, wherein said first wall further comprises a third leg located substantially towards said first end connecting said first leg to said second leg and a fourth leg located substantially towards said second end connected to said second leg, and said second wall further comprises a third leg located substantially towards said first end connecting said first leg to said second leg and a fourth leg located substantially towards said second end connected to said second leg.

17. The circuit interrupter of claim 10, wherein said circuit interrupter is a circuit breaker.

18. A circuit interrupter comprising:

a housing having a first contact and a second contact movable with respect to said first contact;

an arcing chamber;

an arc splitter located in said arcing chamber;

an arc runner located in said arcing chamber configured to boost an arc generated from said first contact toward said second contact, said arc runner having two extensions, each of the extensions comprising at least one portion through which current flows substantially parallel to said arc for generating a magnetic force on said arc pushing said arc toward said arc splitter when a current passes through said arc runner.

19. The circuit interrupter of claim 18, wherein said first contact is fixed to said housing.

20. The circuit interrupter of claim 18 wherein said arc splitter has a plurality of spaced apart plates.

21. The circuit interrupter of claim 18, wherein at least one magnet is located in said arcing chamber pushing said arc towards said arc splitter.

22. The circuit interrupter of claim 21, wherein said at least one magnet is one of a permanent magnet and an iron plate.

23. The circuit interrupter of claim 22, wherein said iron plate is configured to generate a magnetic force when the current flows through the circuit interrupter.

24. The circuit interrupter of claim 23, wherein a coil is electrically connected to said extensions.

25. The circuit interrupter of claim 18, wherein the circuit interrupter is a circuit breaker.

* * * * *